US011939773B2

(12) United States Patent
Rufus et al.

(10) Patent No.: US 11,939,773 B2
(45) **Date of Patent: *Mar. 26, 2024**

(54) ROOFING COMPOSITES WITH INTEGRATED SELVAGE EDGES

(71) Applicant: BMIC LLC, Dallas, TX (US)

(72) Inventors: Isaac Bernard Rufus, Newark, DE (US); Adem Chich, Kearny, NJ (US); Richard Chin, Livingston, NJ (US); Michael Dougherty, Mount Arlington, NJ (US)

(73) Assignee: BMIC LLC, Dallas, TX (US)

( * ) Notice: Subject to any disclaimer, the term of this patent is extended or adjusted under 35 U.S.C. 154(b) by 15 days.

This patent is subject to a terminal disclaimer.

(21) Appl. No.: 17/943,997

(22) Filed: Sep. 13, 2022

(65) Prior Publication Data

US 2023/0003026 A1 Jan. 5, 2023

Related U.S. Application Data

(63) Continuation of application No. 17/484,156, filed on Sep. 24, 2021, now Pat. No. 11,454,028.

(60) Provisional application No. 63/083,595, filed on Sep. 25, 2020.

(51) Int. Cl.

| | |
|---|---|
| ***E04D 5/10*** | (2006.01) |
| ***E04D 5/04*** | (2006.01) |
| ***E04D 5/06*** | (2006.01) |
| ***E04D 5/12*** | (2006.01) |
| ***E04D 5/14*** | (2006.01) |

(52) U.S. Cl.

CPC ..... *E04D 5/10* (2013.01); *E04D 5/04* (2013.01); *E04D 5/06* (2013.01); *E04D 5/12* (2013.01); *E04D 5/148* (2013.01)

(58) Field of Classification Search

CPC .... E04D 5/02; E04D 5/04; E04D 5/06; E04D 5/08; E04D 5/10; E04D 5/12; E04D 5/14; E04D 5/148

USPC ..... 428/40.1, 40.3, 41.7, 41.8, 42.2

See application file for complete search history.

(56) References Cited

U.S. PATENT DOCUMENTS

| | | | |
|---|---|---|---|
| 5,687,517 | A | 11/1997 | Wiercinski et al. |
| 6,296,912 | B1 | 10/2001 | Zickell |
| 6,924,015 | B2 | 8/2005 | Zanchetta et al. |
| 7,146,771 | B2 | 12/2006 | Swann |
| 7,604,707 | B2 | 10/2009 | Bartek et al. |

(Continued)

FOREIGN PATENT DOCUMENTS

| | | |
|---|---|---|
| EP | 2886324 A1 | 6/2015 |
| WO | 2015/117238 A1 | 8/2015 |

*Primary Examiner* — William V Gilbert

(74) *Attorney, Agent, or Firm* — GREENBERG TRAURIG, LLP

(57) ABSTRACT

Some embodiments of the present disclosure relate to roofing composites. In some embodiments, the roofing composite includes a first layer having a top surface. In some embodiments, the top surface of the first layer comprises a first embossed surface portion, a second embossed surface portion, and a flat surface portion between the first and second embossed surface portions. In some embodiments, the flat surface portion is between the first and second embossed surface portions. In some embodiments, the roofing composite is configured to attach to a roof structure, such as a roof deck. Methods of forming roofing composited are also disclosed.

20 Claims, 7 Drawing Sheets

(56) References Cited

U.S. PATENT DOCUMENTS

| | | | |
|---|---|---|---|
| 8,663,413 | B1 | 3/2014 | Peng et al. |
| 11,454,028 | B2 * | 9/2022 | Rufus ..... E04D 5/148 |
| 2004/0241369 | A1 | 12/2004 | Pressutti et al. |
| 2005/0126103 | A1 | 6/2005 | Scheirer et al. |
| 2015/0176281 | A1 | 6/2015 | Yang et al. |
| 2018/0334808 | A1 | 11/2018 | Baldwin et al. |
| 2020/0109565 | A1 | 4/2020 | Sandhar |
| 2020/0270866 | A1 | 8/2020 | Yancey et al. |
| 2021/0095474 | A1 | 4/2021 | Yang et al. |

* cited by examiner

ROOFING COMPOSITES WITH INTEGRATED SELVAGE EDGES

CROSS-REFERENCE TO RELATED APPLICATIONS

This application is a continuation of U.S. patent application Ser. No. 17/484,156, filed Sep. 24, 2021, which claims priority to U.S. Provisional Application No. 63/083,595, filed on Sep. 25, 2020, the entire contents of which are incorporated herein by reference.

FIELD

The present disclosure relates to roofing composites and methods for manufacturing the roofing composites.

BACKGROUND

Traditional roofing composites include selvage edges to ensure a water tight bond when roofing composites are overlapped with one another. Typically, the selvage edges are on films that are attached to edges of roofing composites.

SUMMARY

Covered embodiments are defined by the claims, not this summary. This summary is a high-level overview of various aspects and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification, any or all drawings, and each claim.

Some embodiments of the present disclose are directed to a roofing composite comprising a first layer having top surface wherein the top surface of the first layer comprises a first embossed surface portion, a second embossed surface portion, and a flat surface portion. In some embodiments, the flat surface portion is between the first and second embossed surface portions. In some embodiments, flat surface portion extends along the length of the first layer. In some embodiments, the roofing composite is configured to attach to a roof deck.

In some embodiments, the flat surface portion is a first flat surface portion, and the roofing composite further comprises a second flat surface portion extending along the length of the first layer.

In some embodiments, the roofing composite comprises a third embossed surface portion, wherein the second flat surface portion is between the first embossed surface portion and the third embossed surface portion.

In some embodiments, the roofing composite is configured to attach to a roof covering.

In some embodiments, the first layer comprises a bottom surface, and the roofing composite comprises a second layer attached to the bottom surface of the first layer. In some embodiments, the second layer comprises an adhesive layer. In some embodiments, the second layer comprises a polymer layer.

In some embodiments, the first layer comprises a bottom surface, and the roofing composite comprises a removable liner attached to the bottom surface of the first layer.

In some embodiments, the first embossed surface portion comprises a first width, the flat surface portion comprises a second width, the second embossed surface portion comprises a third width, the first width is greater than the second width, and the second width is greater than the third width. In some embodiments, the second width is between 1" and 5". In some embodiments, the third width is between 0" and 4".

In some embodiments, the first layer is a woven fabric.

In some embodiments, the first layer comprises thermoplastic, thermoset engineering plastic, polyolefin, polyester, natural fibers, polyamide, nylon, a fire retardant, a fire resistant fabric, or any combination thereof.

In some embodiments, the roofing composite comprises a reinforcing layer. In some embodiments, the reinforcing layer comprises glass, polyester, polymer, a fire retardant, a metal foil or film, or any combination thereof.

In some embodiments, the first layer is a non-woven fabric.

In some embodiments, the flat surface portion comprises at least one layer of top surface material attached to the top surface of the first layer.

In some embodiments, the at least one layer of top surface material comprises a coating.

Some embodiments of the present disclose are directed to an article comprising a roofing composite roll, wherein the roofing composite roll comprises a longitudinal axis; and a roofing composite, wherein the roofing composite comprises a first layer having a first embossed surface portion a second embossed surface portion, and a flat surface portion. In some embodiments, the flat surface portion is between the first and second embossed surface portions, and the flat surface portion extends perpendicular to the longitudinal axis of the roofing composite roll. In some embodiments, the roofing composite is configured to attach to a roof deck. In some embodiments, the article comprises a removable liner, wherein the removable liner is attached to the first layer of the roofing composite.

Some embodiments of the present disclosure are directed to a roofing composite comprising a first layer having top surface, a bottom surface, a length and a width, wherein the top surface of the first layer comprises a first embossed surface portion having a width, a second embossed surface portion having a width, wherein the width of the second embossed surface portion is less than the width of the first embossed surface portion; and a flat surface portion having a width, wherein the flat surface portion is between the first and second embossed surface portions, wherein the width of the flat surface portion is less than the width of the first embossed surface portion, wherein the width of the flat surface portion is greater than the width of the second embossed surface portion, and wherein the flat surface portion extends along the length of the first layer. In some embodiments, the roofing composite comprises a second layer attached to the bottom surface of the first layer; and a third layer attached to the second layer, wherein the third layer comprises a removable liner.

DRAWINGS

Some embodiments of the disclosure are herein described, by way of example only, with reference to the accompanying drawings. With specific reference now to the drawings in detail, it is stressed that the embodiments shown are by way of example and for purposes of illustrative discussion of embodiments of the disclosure. In this regard, the description taken with the drawings makes apparent to those skilled in the art how embodiments of the disclosure may be practiced.

DETAILED DESCRIPTION

Figure 1A:
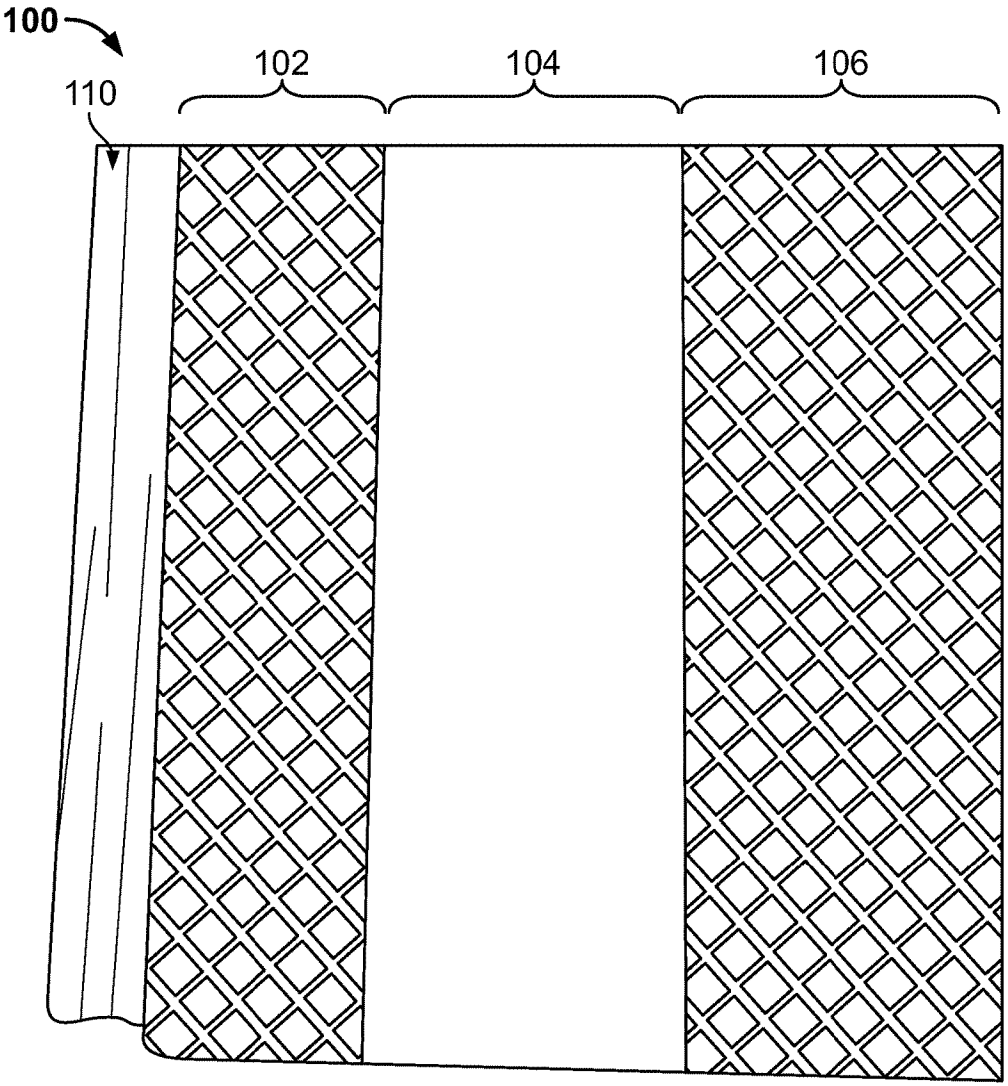
FIGS. 1A-1C depicts an exemplary embodiment of a roofing composite according to the present disclosure.

Among those benefits and improvements that have been disclosed other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure which are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though it may. Furthermore, the phrases "in another embodiment" and "in some other embodiments" as used herein do not necessarily refer to a different embodiment, although it may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising" "including," and "having" do not limit the scope of a specific claim to the materials or steps recited by the claim.

As used herein, the term "consisting essentially of" limits the scope of a specific claim to the specified materials or steps and those that do not materially affect the basic and novel characteristic or characteristics of the specific claim.

As used herein, terms such as "consisting of" and "composed of" limit the scope of a specific claim to the materials and steps recited by the claim.

All prior patents, publications, and test methods referenced herein are incorporated by reference in their entireties.

As used herein, the term "roofing composite" may be a combination of materials that may be used to form one or more components of a roofing system. The one or more components of the roofing system may include, but is not limited to, films, covers, membranes, underlayments, cap sheets, or base sheets.

As used herein, the term "attached" means that two surfaces are in direct or indirect contact with one another.

As used herein, the term "embossed surface" means a smooth surface that has raised portions. In some embodiments, there may be channels between the raised portions.

As used herein, the term "flat surface" means a smooth surface. In some embodiments, a smooth surface is a surface that is not embossed.

As used herein, the term "length" refers to the machine direction of the roofing composite.

Some embodiments of the present disclosure relate to a roofing composite. The roofing composite may include one or more layers of material. In some embodiments, the roofing composite may include a first layer. In some embodiments, the first layer may include any suitable material known to those skilled in the art that may be configured to be used to make components of roofing systems (e.g., films, underlayments, base sheets, or membranes). For example, in some embodiments, the first layer may be a woven or non-woven fabric or polymer film and may comprise thermoplastic, thermoset engineering plastic, polyolefin, polyester, natural fibers, polyamide, nylon, a fire retardant, a fire resistant fabric, a metal foil or film, or combinations thereof.

In some embodiments, the first layer may include a top surface, a bottom surface, a length and a width. In some embodiments, the top surface of the first layer may include a first edge and a second edge. In some embodiments, the first and second edges may be parallel to one another.

In some embodiments, the first layer may be an embossed surface, i.e., a first embossed surface layer. As discussed above, an embossed surface may be a smooth surface that has raised portions. In some embodiments, there may be channels between the raised portions. In some embodiments, the raised portions may be formed by any chemical or mechanical means known to those skilled in the art. In other embodiments, the raised portions may be the natural surface of the material of the first layer material without the aid of any chemical or mechanical means. In some embodiments, the first layer may be embossed along its top surface. In some embodiments, the embossed surface may extend from the first edge to the second edge of the first layer.

In some embodiments, the first layer may include a first embossed surface portion, a second embossed surface portion and at least one flat surface portion. In some embodiments, the flat surface portion may be between the first and second embossed surface portions. In some embodiments, the flat surface portion may extend along the length of the first layer. In some embodiments, the flat surface portion may extend along the width of the first layer. In some embodiments, the flat surface portion may be a first flat surface portion and the roofing composite may include a second flat surface portion. In such embodiments, the first and second flat surface portions may extend along both the length and the width of the first layer. In some embodiments, the second embossed surface portion may be between the first flat surface portion and the second flat surface portion. In some embodiments, the first layer may include a third embossed surface portion. In some embodiments, the second flat surface portion may be between the first embossed surface portion and the third embossed surface portion.

In some embodiments, the roofing composite may be wound so as to form a roll. In some embodiments, the roll may include a longitudinal axis. In some embodiments, the flat surface portion may extend perpendicular to the longitudinal axis of the roll.

In some embodiments, the at least one flat surface portion may be a smooth surface. In some embodiments, the at least one flat surface portion may be a substantially smooth surface. In some embodiments, the at least one flat surface portion may be capable of forming a seal with properties according to ASTM D 1970.

In some embodiments, the first embossed surface portion may include a first width. In some embodiments, the at least one flat surface portion may include a second width. In some embodiments, the second embossed surface portion may include a third width. In some embodiments, the first width is greater than the second width. In some embodiments, the second width is the same as the third width. In some embodiments, the second width is greater than the third width.

In some embodiments, the second width may be from 1" to 12", from 1" to 11", from 1" to 10", from 1" to 9", from 1" to 8", from 1" to 7", from 1" to 6", from 1" to 5", from 1" to 4", from 1" to 3", from 1" to 2", from 2" to 12", from 3" to 12", from 4" to 12", from 5" to 12", from 6" to 12", from 7" to 12", from 8" to 12", from 9" to 12", from 10" to 12", from 11" to 12", from 2" to 11", from 3" to 10", from 4" to 9", from 5" to 8", or from 6" to 7".

In some embodiments, the third width may be from 0.1" and 4", from 0.1" to 3.5", from 0.1" to 3", from 0" to 2.5", from 0.1" to 2", from 0.1" to 1.5", from 0.1" to 1", from 0.1" to 0.5", from 0.5" to 4", from 1" to 4", from 1.5" to 4", from 2" to 4", from 2.5" to 4", from 3" to 4", from 3.5" to 4", from 0.5" to 3.5", from 1" to 3", or from 1.5" to 2.5".

In some embodiments, the second flat surface portion may comprise a fourth width. In some embodiments, the fourth width may be from 0.1" and 4", from 0.1" to 3.5", from 0.1" to 3", from 0.1" to 2.5", from 0.1" to 2", from 0.1" to 1.5", from 0.1" to 1", from 0.1" to 0.5", from 0.5" to 4", from 1" to 4", from 1.5" to 4", from 2" to 4", from 2.5" to 4", from 3" to 4", from 3.5" to 4", from 0.5" to 3.5", from 1" to 3", or from 1.5" to 2.5".

In some embodiments the third width is the same is the fourth width. In some embodiments, the third width is different from the fourth width.

In some embodiments, the at least one flat surface portion may include a first edge and a second edge. In some embodiments, the first edge of the at least one flat surface portion may be parallel to the second edge of the at least one flat surface portion. In some embodiments, the first edge of the first layer may be parallel to the first edge of the at least one flat surface portion. In some embodiments, the first edge of the first layer may extend beyond the first edge of the flat surface portion. In some embodiments, the second edge of the first layer may be parallel to the second edge of the at least one flat surface portion. In some embodiments, the second edge of the first layer may extend beyond the second edge of the flat surface portion. In some embodiments, a distance between the first edge of the first layer and the first edge of the flat surface portion may be from 0.1" and 4", from 0.1" to 3.5", from 0.1" to 3", from 0.1" to 2.5", from 0.1" to 2", from 0.1" to 1.5", from 0.1" to 1", from 0.1" to 0.5", from 0.5" to 4", from 1" to 4", from 1.5" to 4", from 2" to 4", from 2.5" to 4", from 3" to 4", from 3.5" to 4", from 0.5" to 3.5", from 1" to 3", or from 1.5" to 2.5".

In some embodiments, a distance between the first edge and the second edge of the at least one flat surface portion, i.e., the width of the at least one flat surface portion, is greater than the distance between the first edge of the first layer and the first edge of the flat surface portion.

In some embodiments, the roofing composite may include at least one layer of top surface material that may be directly or indirectly attached to the top surface of the first layer of the roofing composite. In some embodiments, the at least one layer of top surface material may be configured to form the flat surface portion between the first and second embossed surface portions on the top surface of the roofing composite. In some embodiments, the at least one layer of top surface material may include a polymeric coating, polymer film, inks, sealants, primers, water based and solvent based coatings, dispersions, emulsions, or combinations thereof.

In some embodiments, the at least one layer of topic surface material may have a thickness. In some embodiments, the thickness may be from 1 mil to 20 mil, from 1 mil to 18 mil, from 1 mil to 16 mil, from 1 mil to 14 mil, from 1 mil to 12 mil, from 1 mil to 10 mil, from 1 mil to 8 mil, from 1 mil to 6 mil, from 1 mil to 4 mil, from 1 mil to 2 mil, from 3 mil to 20 mil, from 5 mil to 20 mil, from 7 mil to 20 mil, from 9 mil to 20 mil, from 11 mil to 20 mil, from 13 mil to 20 mil, from 15 mil to 20 mil, from 17 mil to 20 mil, from 19 mil to 20 mil, from 3 mil to 18 mil, from 5 mil to 16 mil, from 7 mil to 14 mil, from 9 mil to 12 mil, or from 11 mil to 10 mil.

In some embodiments, the roofing composite may include at least one layer of bottom surface material that may be directly or indirectly attached to the bottom surface of the roofing composite. The at least one layer of bottom surface material may be a second or third layer of the roofing composite. In some embodiments, the at least one layer of bottom surface material may be an adhesive layer, a polymer layer, a polymeric coating, polymer film, inks, sealants, primers, water based and solvent based coatings, dispersions, emulsions, or combinations thereof.

In some embodiments, the at least one layer of bottom surface material may be chosen based on the material composition of the first layer of the roofing composite. For example, in some embodiments, if the first layer of material comprises at least one of polyolefin, polyester, natural fibers, polyamide, nylon, or combinations thereof, then the layer of bottom surface material may include a polymer. In some embodiments, the first layer of material may comprise a non-woven fabric and the at least one layer of bottom surface material may be a polymer layer. In addition, in some embodiments, the at least one layer of bottom surface material may include multiple layers of polymer film.

In some embodiments, the roofing composite may be configured to attach to a roof deck or other roof structure, including, without limitation, a roof covering or another roof composite. In some embodiments, the roofing composite may be configured to attach to these roof structures via any means known to those skilled in the art that are suitable for bonding a roofing composite to a roof deck, including for example nails, staples, or other mechanical means, adhesives, or combinations thereof. For example, in some embodiments, the roofing composite may include an adhesive that may be directly or indirectly attached to the bottom surface of the first layer of the roofing composite. In some embodiments, the adhesive may include polyolefin, polymers, poly-alpha-olefin (APAO/APO) polymer, Butyl, SIS, SBS, SEBS, and/or SBR, ethylene vinyl acetate, poly vinyl acetate, acrylic, polyurethane, silane terminated polymer, asphaltic adhesives, hot melt adhesives, non-asphaltic adhesives, urethane, or any combination thereof.

In some embodiments, the roofing composite may further include a removable liner. In some embodiments, when a layer of material including an adhesive, i.e., an adhesive layer, is attached to the bottom surface the first layer of the roofing composite, the removable liner may be removably attached to the adhesive layer. In some embodiments, the removable liner may include any suitable material known to those skilled in the art that may be configured to attach to the adhesive layer and to be removed from the adhesive layer without affecting the properties of the adhesive layer.

In some embodiments, the roofing composite may also include a reinforcing layer. In some embodiments, the reinforcing layer may be configured to provide support and/or reinforcement to the roofing composite. In some embodiments, the reinforcing layer may be attached to the layer of material that is attached to the bottom surface of the first layer of the roofing composite. In some embodiments, the reinforcing layer may include any suitable reinforcement material known to those skilled in the art including glass, polyester, nylon, non-woven polyolefin, non-woven polymer fiber composite, spun bond polymer fiber mats, or any combination thereof.

Some embodiments of the present disclosure are directed to methods. In some embodiments, the methods may be methods of forming roofing composites, including for example, the roofing composites described in the present disclosure. In some embodiments, the methods may include embossing a top surface of a first layer of a roofing composite. In some embodiments embossing may include forming raised portions and channels between the raised portions in the top surface of the first layer. In some embodiments, the raised portions and channels may be formed in the top surface of the first layer by any chemical or mechanical means known to those skilled in the art.

As discussed herein, in some embodiments, the first layer may include at least one flat surface portion. In some embodiments, the method may include forming the at least one flat surface portion on the embossed top surface of the first layer of the roofing composite along the length of the first layer. In some embodiments, the at least one flat surface portion may be formed between the first and second edges of the first layer of the roofing composite. In some embodiments, the at least one flat surface portion may be a first flat surface portion. In some embodiments, the method may include forming a second flat surface portion between the first and second edges of the first layer of the roofing composite.

As discussed herein, the first layer of the roofing composite may include a first embossed surface portion and a second embossed surface portion. In some embodiments of the method, the at least one flat surface portion may be formed so as to form the first embossed surface portion, the second embossed surface portion, and the flat surface portion between the first and second embossed surface portions. In some embodiments, the at least one flat surface portion may be a first flat surface portion. In some embodiments, the second flat surface portion may be formed so as to form a third embossed surface portion.

In some embodiments, forming the at least one flat surface portion may include hot melting a portion of the embossed top surface of the first layer between the first edge and the second edge of the first layer. In some embodiments, hot melting be done for a sufficient time and at a sufficient heat so as to remove the raised portions and channels the hot melted portion of the embossed top surface of the first layer between the first edge and the second edge of the first layer.

In some embodiments, forming the at least one flat surface portion may include attaching at least one layer of top surface material to a portion of the embossed top surface of the first layer between the first edge and the second edge of the first layer. In some embodiments, the at least one layer of top surface material may be attached to the portion of the embossed top surface so as to fill in the channels between the raised portions on the portion of the embossed top surface. In some embodiments, attaching the at least one layer of top surface material to the portion of the embossed top surface may be done by extrusion, co-extrusion, lamination, roll coating, die coating, or spraying.

In some embodiments, the flat surface portion may be formed along the length of the roofing composite. In some embodiments, the flat surface portion may be formed along the width of the roofing composite.

As discussed herein, in some embodiments, the roofing composite may include at least one layer of bottom surface material directly or indirectly attached to the bottom surface of the first layer. In some embodiments, the method may include attaching the at least one layer of bottom surface material to a bottom surface of the first layer. In some embodiments, the at least one layer of bottom surface material may be attached to the bottom surface of the first layer by lamination, extrusion, or co-extrusion. In some embodiments, attaching the at least one layer of bottom surface material to the bottom surface of the first layer may include attaching a polymer layer. In some embodiments, attaching the at least one layer of bottom surface material to the bottom surface of the first layer may include attaching an adhesive layer. In some embodiments, attaching the at least one layer of bottom surface material to a bottom surface of the first layer may include attaching a removable liner to the adhesive layer. In some embodiments, attaching at least one layer of bottom surface material to a bottom surface of the first layer may include attaching a reinforcement layer.

The present disclosure will now be described with reference to non-limiting exemplary embodiments depicted in FIGS. 1-8.

Figure 1B:
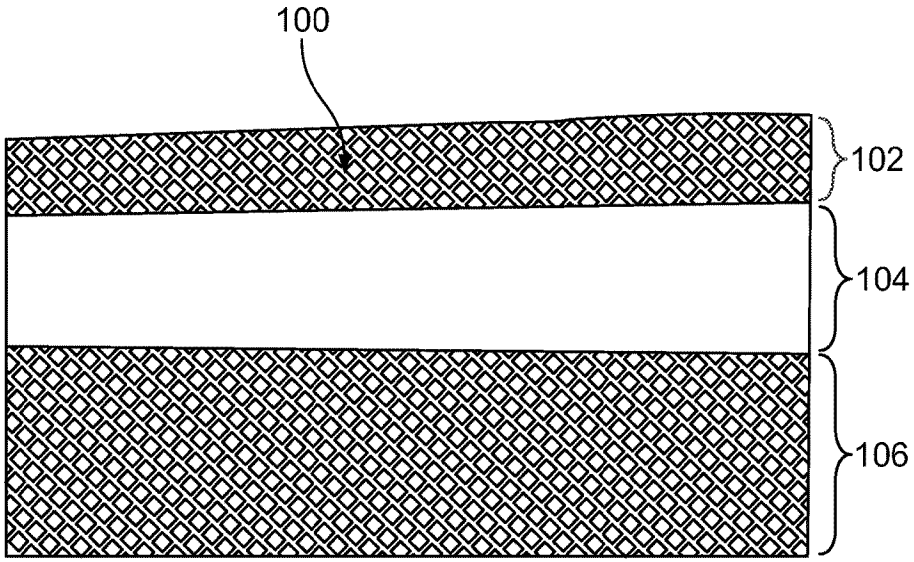
Figure 1C:
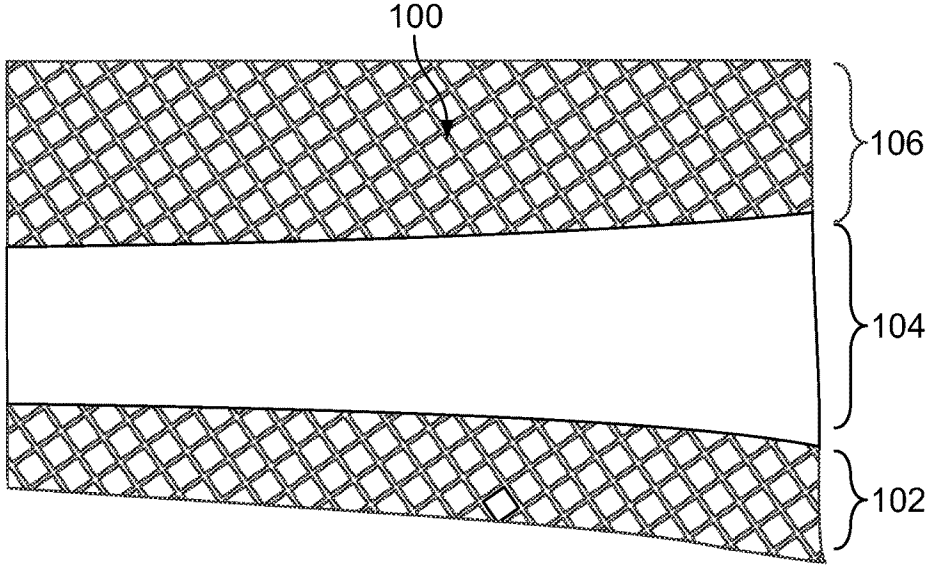

FIGS. 1A-1C depict an exemplary embodiment of a roofing composite 100 according to the present disclosure. As shown in FIG. 1A, the roofing composite 100 may include a first embossed surface portion 106, a second embossed surface portion 102, and a flat surface portion 104. In the embodiment of FIGS. 1A-1C, the first and second embossed surface portions 102, 106 and the flat surface portion 104 may form the top surface of the first layer of the roofing composite 100. FIG. 1A depicts that a removable liner 110 may be attached to a bottom surface of the first layer of the roofing composite 100. In addition, as shown in FIGS. 1A-1C, the width of the second embossed surface portion 102 may be less than the width of the flat surface portion 104. In the exemplary embodiment of FIGS. 1A-1C, the flat surface portion 104 may extend along the length of the roofing composite 100.

Figure 2:
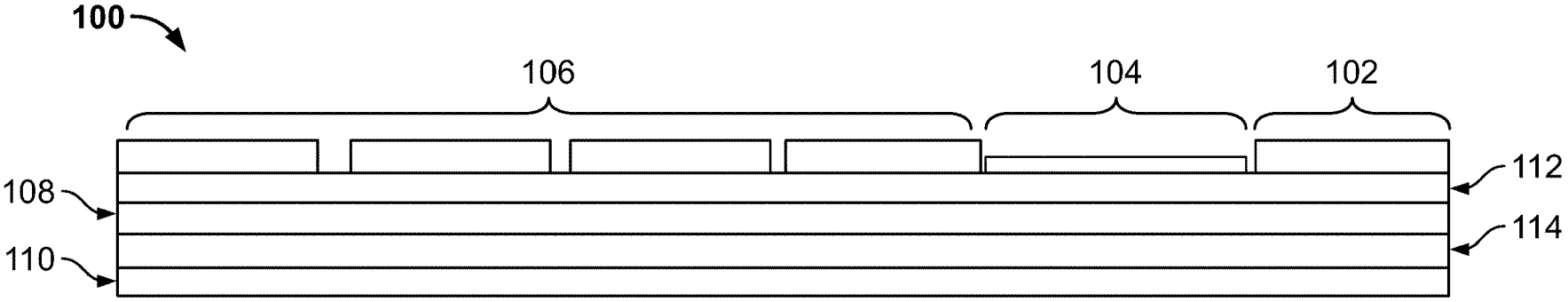
FIG. 2 depicts a cross-sectional view of the roofing composite of FIGS. 1A-C.

FIG. 2 depicts a cross-sectional view of the roofing composite 100 depicted in FIG. 1 along the width of the roofing composite 100. As shown in FIG. 2, the roofing composite 100 includes the first embossed surface portion 106, the second embossed surface portion 102, and the flat surface portion 104. As shown in FIG. 2, in some embodiments, the first embossed surface portion 106 includes a first width, the flat surface portion 104 includes a second width, and the second embossed surface portion 102 includes a third width. In some embodiments, the first, second and third widths may be the same. In some embodiments, the first, second, and third widths may be different from one another. As shown in FIG. 1, the embossed surface portions 102, 106 include raised portions 1 and channels 2 between the raised portions.

FIG. 2 depicts that multiple layers of bottom surface material may be attached to the bottom surface of the first layer of the roofing composite 100. The layers of bottom surface material may include an asphalt-based material, such as modified bitumen 112 and a reinforcing layer 108. FIG. 2 depicts that the reinforcing layer 108 may be a glass mat.

In other exemplary embodiments of the present disclosure, the reinforcing layer 108 may be polyester reinforcement, woven or non-woven reinforcements, or a combination thereof. In addition, the roofing composite depicted in FIG. 2 may include an adhesive layer 114, and a removable liner 110.

Figure 3:
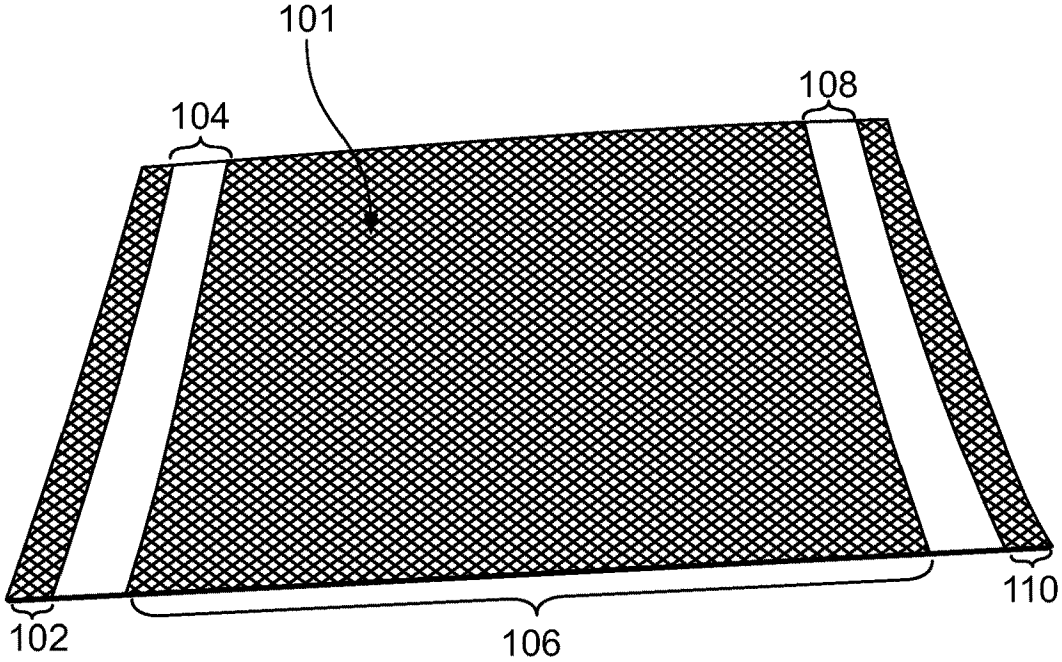
FIG. 3 depicts an exemplary embodiment of a roofing composite according to the present disclosure.

FIG. 3 depicts an exemplary embodiment of a roofing composite 101 according to the present disclosure. As shown in FIG. 3, in some embodiments, the roofing composite 101 may include a first flat surface portion 104 and a second flat surface portion 108. As shown in FIG. 3, in some embodiments, the first flat surface portion may be between the first embossed surface portion 106 and the second embossed surface portion 102. As shown in FIG. 3, in some embodiments, the second flat surface portion 108 may be between the first embossed surface portion 106 and a third embossed surface portion 110.

Figure 4:
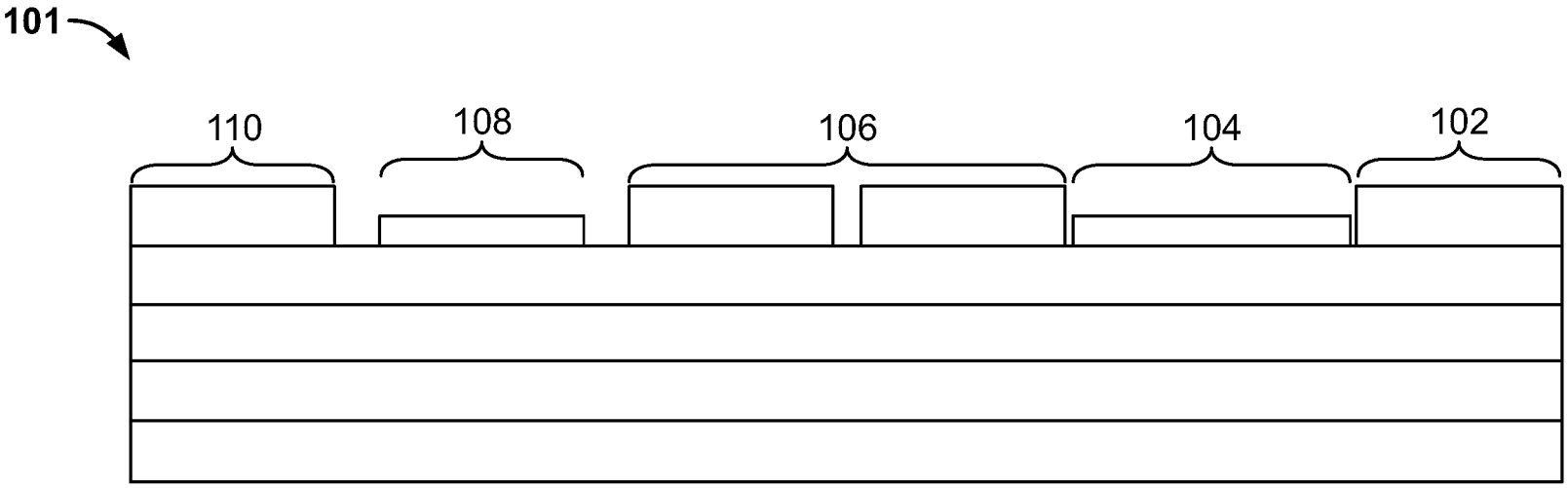
FIG. 4 depicts a cross-sectional view of the roofing composite of FIG. 3.

FIG. 4 depicts a cross-sectional view of the roofing composite 101 of FIG. 3 along the width of the roofing composite 101. As shown in FIG. 4, in some embodiments, the top surface of the roofing composite 101 may include the first embossed surface portion 106, the second embossed surface portion 102, and the third embossed surface portion 110. As shown in FIG. 4, in some embodiments, the top surface of the roofing composite 101 may include a first flat surface portion 104 between the first embossed surface portion 106 and the second embossed surface portion 102. In addition, as shown in FIG. 4, in some embodiments, the second flat surface portion 108 may be between the first embossed surface portion 106 and the third embossed surface portion 110. As shown in FIG. 4, the first embossed surface portion 106 includes a first width, the first flat surface portion 104 includes a second width, the second embossed surface portion 102 includes a third width, the second flat surface portion 108 includes a fourth width, and the third embossed surface portion 110 includes a fifth width. In some embodiments, the second width and the fourth width may be the same. In some embodiments, the second width and the fourth width may be different. In some embodiments, third width and the fifth width may be the same. In some embodiments, the third width and the fifth width may be different. In some embodiments, one or more widths of the embossed surface portions may be the same as one or more widths of the flat surface portions.

FIG. 4 also shows that in some embodiments, the roofing composite 101 may include multiple layers of bottom surface material. Exemplary embodiment of FIG. 4, the layers of bottom surface material may be the same as the layers of bottom surface material depicted in FIG. 2.

Figure 5:
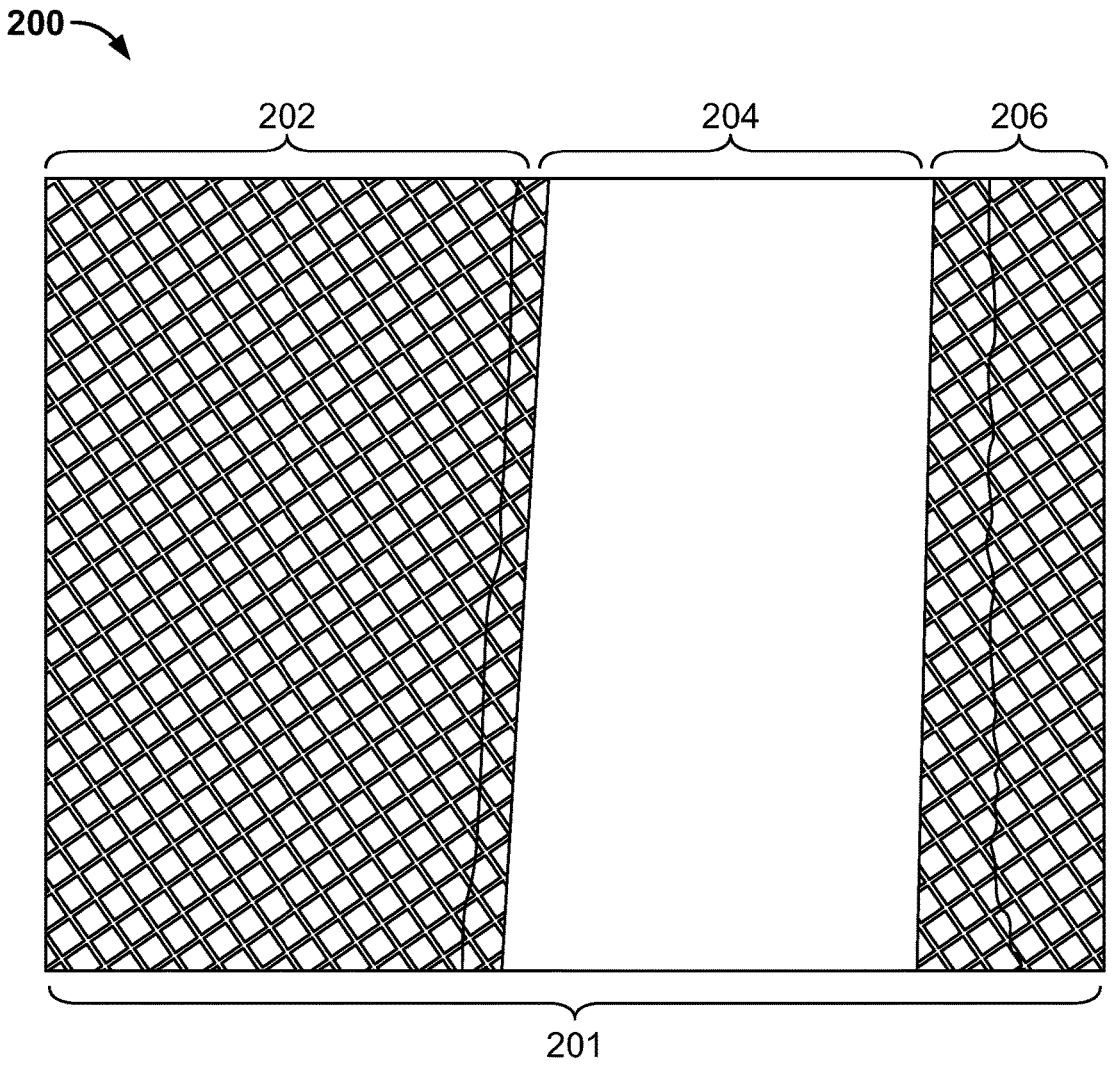
FIG. 5 depicts an exemplary embodiment of a roofing composite according to the present disclosure.

FIG. 5 depicts an exemplary embodiment of a roofing composite 200 according to the present disclosure. The roofing composite 200 may include a first layer 201 with an embossed top surface. FIG. 5 further depicts layer of material 204 may be attached to the embossed top surface the first layer 201, so that the roofing composite 200 has a first embossed surface portion 202, a second embossed surface portion 206, and a flat surface portion 204 between the first and second embossed surface portions. In the exemplary embodiment of FIG. 5, the layer of material 204 may extend along the length or the width of the roofing composite 200. In addition, FIG. 5 depicts that the layer of material 204 may be a coating. In other exemplary embodiments, the layer of material 204 may be a polymer, polymer film, powder coating, an adhesive, or combinations thereof.

Figure 6:
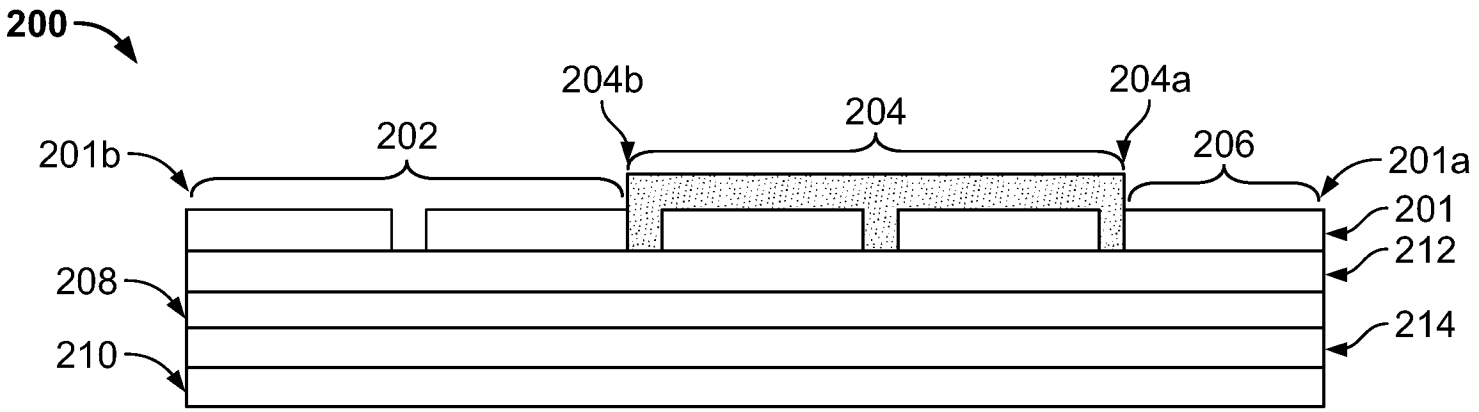
FIG. 6 depicts a cross-sectional view of the roofing composite of FIG. 5.

FIG. 6 depicts a cross-sectional view of the roofing composite 200 of FIG. 5 along the width of the roofing composite 200. As shown in FIG. 6, the roofing composite 200 includes the first layer 201 with the embossed top surface having the first embossed surface portion 206, the second embossed surface portion 202, and the flat surface portion 204. As shown in FIG. 6, the first embossed surface portion 206 includes a first width, the flat surface portion 204 includes a second width, and the second embossed surface portion 202 includes a third width. In some embodiments, the first, second and third widths may be the same. In some embodiments, the first, second, and third widths may be different from one another. As shown in FIG. 6, the embossed top surface 201 includes raised portions 1 and channels 2 between the raised portions. The embossed top surface 201 includes a first edge 201*a* and a second edge 201*b*. As shown in FIG. 6, in some embodiments, at least one layer of top surface material 204 may form the flat surface portion. The at least one layer of top surface material 204 may be attached to the embossed top surface 201 of the roofing composite 200 so as to fill in channels 4 between raised portions 1. In some embodiments, the layer of material 204 may be attached (e.g., by lamination) to the top surface 201 of the roofing composite 200 so as to cover the channels 4 to form the flat surface portion.

In addition, as shown in FIG. 6, in some embodiments, at least one layer of top surface material 204 may include a first edge 204*a* and a second edge 204*b*. The first edge of the embossed top surface 201*a* extends beyond the first edge of the layer of material forming the flat surface portion 204*a*, and the second edge of the embossed top surface 201*b* extends beyond the second edge of material forming the flat surface portion 204*b*.

FIG. 6 further depicts that in some embodiments, multiple layers of bottom surface material may be attached to the bottom surface of the first layer of the roofing composite 200. The layers of bottom surface material may include an asphalt-based material, such as modified bitumen 212 and a reinforcing layer 208. FIG. 6 depicts that the reinforcing layer 208 may be a glass mat. In other exemplary embodiments of the present disclosure, the reinforcing layer 208 may be polyester reinforcement, woven or non-woven reinforcements, or a combination thereof. In addition, the roofing composite depicted in FIG. 6 may include an adhesive layer 214, and a removable liner 210.

Figure 7:
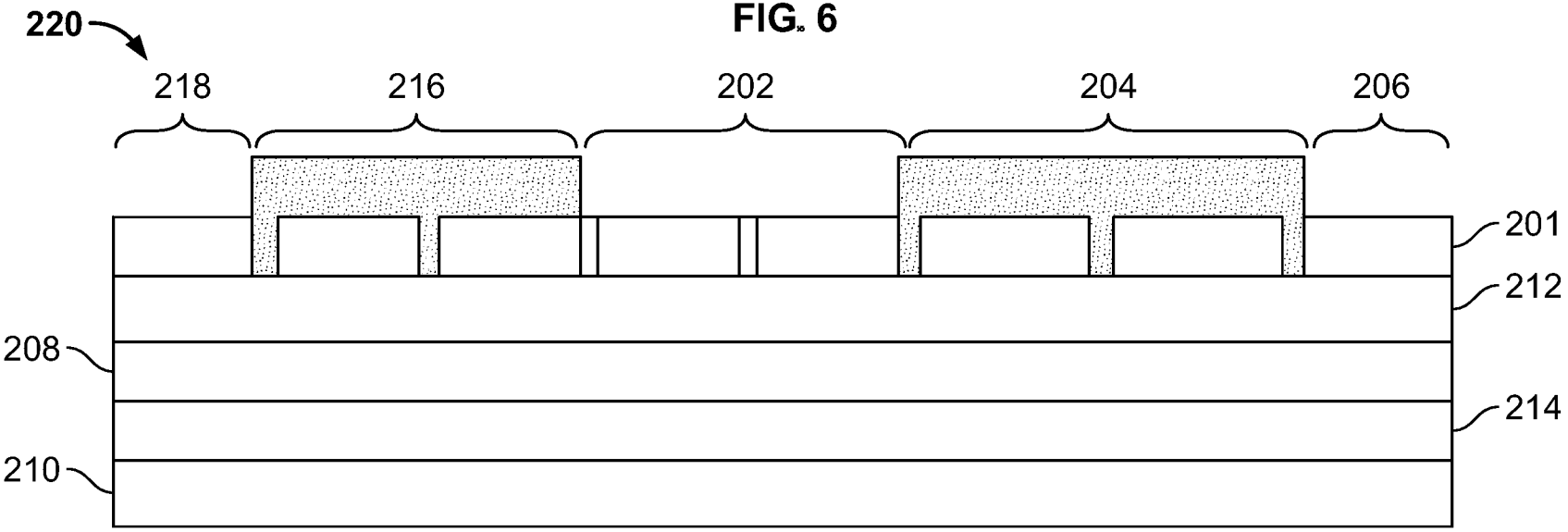
FIG. 7 depicts a cross-sectional view of a roofing composite according to the present disclosure.

FIG. 7 depicts a cross-sectional view of a roofing composite 220 according to the present disclosure along the width of the roofing composite 220. As shown in FIG. 7, in some embodiments, the roofing composite 220 comprises a first layer 201 with the embossed top surface having a first embossed surface portion 206, a second embossed surface portion 202, and a third embossed surface portion 218. As shown in FIG. 7, in some embodiments, the top surface 201 includes a first flat surface portion 204 and a second flat surface portion 216. As shown in FIG. 7, in some embodiments, the first flat surface portion 204 is at least one layer of top surface material. As shown in FIG. 7, the first embossed surface portion 206 includes a first width, the first flat surface portion 204 includes a second width, the second embossed surface portion 202 includes a third width, the second flat surface portion 216 includes a fourth width, and the third embossed surface portion 218 includes a fifth width. In some embodiments, the second width and the fourth width may be the same. In some embodiments, the second width and the fourth width may be different. In some embodiments, third width and the fifth width may be the same. In some embodiments, the third width and the fifth width may be different. In some embodiments, one or more widths of the embossed surface portions may be the same as one or more widths of the flat surface portions. In addition, as shown in FIG. 7, the second flat surface portion 216 is at least one layer of top surface material. The at least one layer of top surface material 204, 216 may be attached to the embossed top surface 201 of the roofing composite 200 so as to fill in channels between raised portions in the embossed top surface 201 of the roofing composite 220.

FIG. 7 further depicts that in some embodiments, multiple layers of bottom surface material may be attached to the bottom surface of the first layer of the roofing composite 220. The layers of bottom surface material may include an asphalt-based material, such as modified bitumen 212 and a reinforcing layer 208. FIG. 7 depicts that the reinforcing layer 208 may be a glass mat. In other exemplary embodiments of the present disclosure, the reinforcing layer 208 may be polyester reinforcement, woven or non-woven reinforcements, or a combination thereof. In addition, the roofing composite depicted in FIG. 7 may include an adhesive layer 214, and a removable liner 210.

Figure 8:
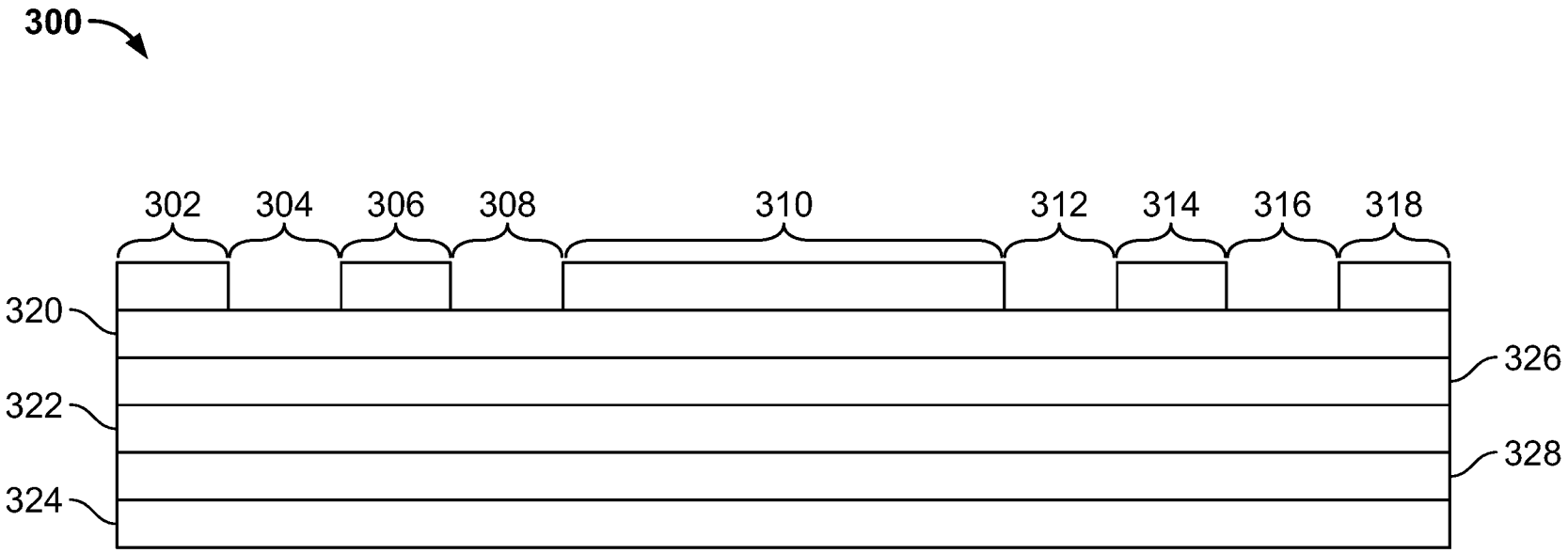
FIG. 8 depicts a cross-sectional view of a roofing composite according to the present disclosure.

FIG. 8 depicts a cross-sectional view of a roofing composite 300 according to the present disclosure along the width of the roofing composite 300. As shown in FIG. 8, in some embodiments, the top surface of the roofing composite may comprise a non-woven material. In some embodiments, the non-woven material may not be embossed. As shown in FIG. 8, in some embodiments, the top surface of the roofing composite 300 may include a first non-woven surface portion 302, a second non-woven surface portion 306, a third non-woven surface portion 312, a fourth non-woven surface portion 314, and a fifth non-woven surface portion 318. As shown in FIG. 8, in some embodiments, the top surface of the roofing composite 300 may include a first flat surface portion 304 between the first non-woven surface portion 302 and the second non-woven surface portion, a second flat surface portion 308 between the second non-woven surface portion 306 and the third non-woven surface portion 310, a third flat surface portion 312 between the third non-woven surface portion 310 and the fourth non-woven surface portion 314, and a fourth flat surface portion 316 between the fourth non-woven surface portion 314 and the fifth non-woven surface portion 318. As shown in FIG. 8, the first non-woven surface portion 302 includes a first width, the first flat surface portion 304 includes a second width, the second non-woven surface portion 306 includes a third width, the second flat surface portion 308 includes a fourth width, the third non-woven surface portion 310 includes a fifth width, the third flat surface portion 312 includes a sixth width, the fourth non-woven surface portion 314 includes a seventh width, the fourth flat surface portion 316 includes an eighth width, and the fifth non-woven surface portion 318 includes a ninth width. In some embodiments, the widths of the non-woven surface portions may be the same. In some embodiments, the widths of the non-woven surface portions may be different from one another. In some embodiments, the widths of the flat surface portions may be the same. In some embodiments, the widths of the flat surface portions may be different from one another. In some embodiments, one or more widths of the flat surface portions may be the same as one or more widths of the non-woven surface portions.

As shown in FIG. 8, in some embodiments the roofing composite 300 may include multiple layers of bottom surface material 320, 322, 324, 326, 328. As shown in FIG. 8, in some embodiments the layers of bottom surface material may include a reinforcing layer 322. As shown in FIG. 8, in some embodiments, the reinforcing layer 322 may be a glass mat, polyester reinforcement, woven or non-woven reinforcements, or any combination thereof. As shown in FIG. 8, in some embodiments, the multiple layers of bottom surface material may include a polymer film 324. As shown in FIG. 8, in some embodiments, the polymer film 324 may be a releasable liner. As shown in FIG. 8, in some embodiments, the multiple layers of bottom surface material may include a top layer of roof coverings or composites 326. In some embodiments, the top layer of roof coverings or composites 326 may include at least one of an adhesive, a polymer modified asphalt, a butyl adhesive, an acrylic adhesive, a polyurethane adhesive, a silicone adhesive, an SBR adhesive, a polymer, a thermoplastic, or any combination thereof. As shown in FIG. 8, in some embodiments, the multiple layers of bottom surface material may include a bottom layer of roof coverings or composites 328. In some embodiments, the top layer of roof coverings or composites 328 may include at least one of an adhesive, a polymer modified asphalt, a butyl adhesive, an acrylic adhesive, a polyurethane adhesive, a silicone adhesive, an SBR adhesive, a polymer, a thermoplastic, or any combination thereof. In some embodiments, the material composition of the top layer of roof coverings or composites 326 may be the same as the material composition of the bottom layer of roofing coverings or composites 328. In some embodiments, the material composition of the top layer of roof coverings or composites 326 may be different from the material composition of the bottom layer of roofing coverings or composites 328. In some embodiments, the top layer of roof coverings or composites 326 may include a filler or fire retardant. In some embodiments, the filler or fire retardant may include Colemanite, Alumina trihydrate, Magnesium hydroxides, expandable graphite, halogen based fire retardants, phosphorus and nitrogen based fire retardants, or any combination thereof. In some embodiments, the bottom layer of roof coverings or composites 328 may include a filler or fire retardant. In some embodiments, the filler or fire retardant may include Colemanite, Alumina trihydrate, Magnesium hydroxides, expandable graphite, halogen based fire retardants, phosphorus and nitrogen based fire retardants, or any combination thereof. In some embodiments, the filler or fire retardant in the top layer of roof coverings or composites 326 may be the same as the filler or fire retardant in the bottom layer of roofing coverings or composites 328. In some embodiments, the filler or fire retardant in the top layer of roof coverings or composites 326 may be different from the filler or fire retardant in the bottom layer of roofing coverings or composites 328. In some embodiments, the filler or fire retardant in the top layer of roof coverings or composites 326 may present in the same amount as the filler or fire retardant in the bottom layer of roofing coverings or composites 328. In some embodiments, the filler or fire retardant in the top layer of roof coverings or composites 326 may present in a different amount as the filler or fire retardant in the bottom layer of roofing coverings or composites 328.

Variations, modifications and alterations to embodiments of the present disclosure described above will make themselves apparent to those skilled in the art. All such variations, modifications, alterations and the like are intended to fall within the spirit and scope of the present disclosure, limited solely by the appended claims.

While several embodiments of the present disclosure have been described, it is understood that these embodiments are illustrative only, and not restrictive, and that many modifications may become apparent to those of ordinary skill in the art. For example, all dimensions discussed herein are provided as examples only, and are intended to be illustrative and not restrictive.

Any feature or element that is positively identified in this description may also be specifically excluded as a feature or element of an embodiment of the present as defined in the claims.

The disclosure described herein may be practiced in the absence of any element or elements, limitation or limitations, which is not specifically disclosed herein. Thus, for example, in each instance herein, any of the terms "comprising," "consisting essentially of" and "consisting of" may be replaced with either of the other two terms, without altering their respective meanings as defined herein. The terms and expressions which have been employed are used as terms of description and not of limitation, and there is no intention in the use of such terms and expressions of excluding any equivalents of the features shown and described or portions thereof, but it is recognized that various modifications are possible within the scope of the disclosure.

What is claimed is:

1. A method, comprising:
obtaining a first composite,
wherein the first composite comprises:
a first layer having,
a bottom surface, and
a top surface,
wherein the top surface is opposite the bottom surface,
wherein the top surface comprises:
a first embossed surface portion,
a second embossed surface portion, and
a flat surface portion,
wherein the flat surface portion is between the first and second embossed surface portions,
wherein the flat surface portion is configured to form a seal with a component disposed thereon,
wherein the flat surface portion extends along a length of the first layer, and
positioning the bottom surface of the first composite proximate a building structure.

2. The method of claim 1, wherein the top surface comprises a second flat surface portion.

3. The method of claim 2, wherein the top surface comprises a third embossed surface portion, and
wherein the second flat surface portion is between the first embossed surface portion and the third embossed surface portion.

4. The method of claim 1, wherein the first composite further comprises a second layer attached to the bottom surface.

5. The method of claim 4, wherein the second layer comprises an adhesive layer.

6. The method of claim 1, further comprising:
obtaining a second composite; and
positioning the second composite on so as to form a seal between a surface of the second composite and the flat surface portion.

7. The method of claim 1, wherein the first layer comprises thermoplastic, thermoset engineering plastic, polyolefin, polyester, natural fibers, polyamide, nylon, a fire retardant, a fire resistant fabric, or any combination thereof.

8. The method of claim 1,
wherein the first composite further comprises a reinforcing layer, and
wherein the reinforcing layer comprises glass, polyester, polymer, a fire retardant, a metal foil, or a metal film.

9. A system, comprising:
a building structure; and
a first composite,
wherein the first composite comprises:
a first layer having,
a bottom surface, and
a top surface,
wherein the top surface is opposite the bottom surface,
wherein the top surface comprises:
a first embossed surface portion,
a second embossed surface portion, and
a flat surface portion,
wherein the flat surface portion is between the first and second embossed surface portions,
wherein the flat surface portion is configured to form a seal with a component disposed thereon, and
wherein the flat surface portion extends along a length of the first layer, and
wherein the bottom surface is located adjacent the building structure.

10. The system of claim 9, wherein the top surface further comprises a second flat surface portion.

11. The system of claim 10, wherein the top surface comprises a third embossed surface portion,
wherein the second flat surface portion is between the first embossed surface portion and the third embossed surface portion.

12. The system of claim 9, wherein the first composite further comprises:
a second layer attached to the bottom surface.

13. The system of claim 12, wherein the second layer comprises an adhesive layer.

14. The system of claim 9, wherein a width of the flat surface portion is between one inch and five inches.

15. The system of claim 9, further comprising:
a second composite,
wherein the second composite seals with the flat surface portion.

16. The system of claim 9, wherein the first layer comprises thermoplastic, thermoset engineering plastic, polyolefin, polyester, natural fibers, polyamide, nylon, a fire retardant, a fire resistant fabric, or any combination thereof.

17. The system of claim 9,
wherein the first composite further comprises a reinforcing layer, and
wherein the reinforcing layer comprises glass, polyester, polymer, a fire retardant, a metal foil, or a metal film.

18. A composite comprising:
a top surface and an adhesive surface opposite the top surface,
wherein the top surface comprises:
a first embossed surface portion,
a second embossed surface portion, and
a flat surface portion,
wherein the flat surface portion is between the first and second embossed surface portions,
wherein the flat surface portion is configured to form a seal with a component disposed thereon, and
wherein an uppermost surface of the flat surface portion is disposed below uppermost surfaces of the first and second embossed surface portions, wherein the flat surface portion extends along a length of the top surface, and wherein the first embossed surface portion comprises a non-woven fabric;

an adhesive on the adhesive surface; and a release liner removably attached to the adhesive.

19. The composite of claim 18, further comprising:

a reinforcing layer, wherein the reinforcing layer comprises glass, polyester, polymer, a fire retardant, a metal foil, or a metal film.

20. The composite of claim 18, wherein the top surface comprises a second flat surface portion, wherein the top surface comprises a third embossed surface portion, and wherein the second flat surface portion is between the first embossed surface portion and the third embossed surface portion.

* * * * *